US006140626A

United States Patent [19]

McKee et al.

[11] Patent Number: 6,140,626

[45] Date of Patent: Oct. 31, 2000

[54] SYSTEM FOR RAPID AIR TEMPERATURE MODIFICATION IN A RECYCLING OVEN

[75] Inventors: Philip R. McKee, Frisco; Earl R. Winkelmann, Garland; Robert S. Briggs, Richardson, all of Tex.

[73] Assignee: TurboChef Technologies, Inc., Dallas, Tex.

[21] Appl. No.: 09/064,988

[22] Filed: Apr. 23, 1998

[51] Int. Cl.[7] ..... H05B 6/64

[52] U.S. Cl. ..... 219/681; 219/400; 99/474

[58] Field of Search ..... 219/681, 682, 219/685, 400, 401; 99/474, 475, 476

[56] References Cited

U.S. PATENT DOCUMENTS

| | | | |
|---|---|---|---|
| 4,420,679 | 12/1983 | Howe | 219/400 |
| 4,467,777 | 8/1984 | Weber | 126/21 A |
| 4,484,561 | 11/1984 | Baggott et al. . | |
| 4,516,012 | 5/1985 | Smith et al. | 219/400 |
| 4,618,756 | 10/1986 | Schwaderer et al. | 219/10.55 R |
| 4,831,225 | 5/1989 | Ishifuro et al. . | |
| 4,873,107 | 10/1989 | Archer . | |
| 5,140,120 | 8/1992 | Kasai et al. . | |
| 5,166,487 | 11/1992 | Hurley et al. . | |
| 5,350,903 | 9/1994 | Takei . | |
| 5,483,044 | 1/1996 | Thorneywork et al. . | |

*Primary Examiner*—Teresa Walberg
*Assistant Examiner*—Shawntina Fuqua
*Attorney, Agent, or Firm*—Amster, Rothstein & Ebenstein

[57] ABSTRACT

In a system for rapid air temperature modification in a recycling oven using hot air impingement for cooking, a fraction of the recycling air may be made to selectively bypass the heat exchanger, thereby to rapidly achieve reduced cook chamber temperatures, as desired by the user. The system includes a shell configured and dimensioned to receive a stream of air through an inlet and to discharge a stream of air through an outlet. The shell is further configured to provide independent first and second paths of travel to guide independent streams of air passing between the inlet and outlet of the shell. The first path houses heating means so that all air passing through this first path will be conditioned (heated) by the heating means. The second path has no heating means and merely permits unimpeded passage of the stream of air through the shell. A mixing space or chamber exists just prior to the outlet of the shell, wherein the air leaving the first path is mixed with the air leaving the second path, so that a single, common thermally-uniform stream of air is created prior to this united stream passing through the outlet and into the cooking chamber.

11 Claims, 2 Drawing Sheets

SYSTEM FOR RAPID AIR TEMPERATURE MODIFICATION IN A RECYCLING OVEN

BACKGROUND OF THE INVENTION

The present invention relates to an air temperature control system in a recycling oven for cooking (both by hot air impingement and microwave energy, or by hot air impingement alone), and more particularly to such an oven which is capable of rapidly cooking food products and rapidly effecting cooking air temperature modifications.

Food service venues, such as grocery stores and convenience stores, often carry food that is typically prepared several hours before the food is purchased by the consumer. Not only does this result in substantial inventory loss if traffic is less than expected, but the food itself is often of lower quality than what might be available from a restaurant because it has been prepared well in advance of sale to the consumer and held in anticipation of sale. This reduced quality, as well as the perception of reduced quality in the minds of consumers, results in lower sales than would occur if the food quality was in line with what is cooked and immediately (or almost immediately) sold in restaurants.

Attempts to deliver "cooked to order" food of high quality within an acceptable time frame have not been entirely successful. Indeed, it is precisely this shortcoming which has prevented the creation of acceptable consumer-operated ovens or hot food vending machines (similar in size and concept to the well known soft drink vending machines) which could turn out national "fast food" chain quality food from a partially or fully automated machine.

Ovens which utilize hot air impingement as the sole method of imparting energy to the food product are not typically used in applications which require rapid cooking (e.g., less than 90 seconds) and delivery to the consumer. In such ovens, because this cooking method works from the outside inward, the impinging hot air has only a limited ability to cook the food interior, especially when the product is of substantial dimensions. This drawback illustrates one of the many disadvantages of the conventional hot air impingement oven—namely, it requires several minutes in order to cook the food product by hot air impingement alone.

Further contributing to this long cook time in an air impingement oven is the time the oven requires to adjust to new temperature settings, whether higher or lower, especially in comparison to a conventional microwave oven. Although the conventional microwave oven does not operate with "temperature" settings, its cooking intensity is rated according to the average power of the magnetron (radio frequency emitting device) over time, and regulation thereof requires a mere adjustment of the electronic controls. Such an adjustment of the electronics provides an instantaneous response by the environment within the cooking chamber of the microwave oven. In contrast, the cooking chamber in an air impingement oven is much slower to respond to adjustment, as air temperature is traditionally a function of a heat exchanger temperature. Hence, for warmer air, the heat exchanger must undergo heating until the heat exchange material thereof is sufficiently hot to condition the air passing over it. In contrast, for cooler air, the heat exchanger must sit idle until the heat exchange material thereof is sufficiently cold to cool the air passing over it. Note that this cooling process can be a slower process because of its passive nature, as opposed to the active process involved in heating the air. Therefore, cook setting adjustments in a microwave oven take effect much quicker than do adjustments, especially temperature-lowering adjustments, in a conventional air impingement oven.

The consumer-operated oven market has been largely limited to microwave ovens over the past several years, partially due to the low cost, familiarity, and fast cook times associated with such ovens. Hence, the menus offered to consumers have likewise been limited to those few food products which prepare fairly well in microwaves (e.g., baked potatoes and popcorn). In contrast to air impingement ovens, conventional microwave ovens tend to heat food outwardly from the food interior, resulting in a "synthetic" product, without browning or crisping. A hybrid oven, combining air impingement technology and microwave energy technology, can not only cook foods with proper browning and crisping, but can cook a wide variety of foods at speeds equal to or faster than conventional microwave ovens.

A satisfactory quick-cooking oven must be able to heat or cook food products—from frozen, refrigerated, or ambient temperature states—whether they are already prepared (e.g., frozen fried chicken nuggets), partially prepared (e.g., frozen "par-baked" pizza), or raw (e.g., biscuits, fish). The process must generally be completed within times that the fast food customer has become accustomed to waiting (generally less than 30–60 seconds for most single portion food products). These various pre-cook states require varying oven temperatures in order to produce quality food products. Hence, such a quick-cooking oven must be able to rapidly transition from one temperature to another, whether higher or lower, between each cook cycle or during a cook cycle. By way of an example, such an oven would permit foods requiring different cooking temperatures to be cooked in the oven in relatively rapid succession. As another example, such an oven would permit proper cooking of certain foods which require different cooking temperatures at different stages in the cooking process. (For example, optionally, certain meats are seared at a high temperature for a brief period of time prior to a normal, lower temperature cooking cycle, thereby minimizing moisture loss from the meat). Clearly, an oven which has but a single cooking temperature cannot provide the different cooking temperatures required for different foods, or the different cooking temperatures over a cook cycle required for certain other foods. At present the ovens maintain different zones of the cooking chamber at different temperatures rather than having the cooking temperature being customized and individually arranged for each particular food. Such ovens require the foods to be placed in the appropriate zone and possibly, at a later stage in the cooking process, relocated to a different zone.

It will be readily appreciated that an oven which can complete the cooking process in 30 seconds can enable food to be sold at twice the rate during peak hours than a machine which requires a minute, whether the oven is disposed in a fast food restaurant, in an ancillary foodservice location such as a convenience store, or as part of an automatic vending machine. Additionally, there is a threshold to the amount of time most consumers will wait for a food product to be delivered. Although there may be some debate as to what that threshold time limit is, it is clear that far fewer customers will knowingly wait 90 seconds for delivery of their food than will wait 30 seconds. Meeting the desires of this marginal customer group would also result in additional sales.

A hybrid oven that employs a system to rapidly achieve modified settings for the temperature of the cooking air is capable of successfully delivering "cooked to order" food of high quality within an acceptable time frame. Such an oven enables mastery of the "cooked to order" concept due to the ability of the oven to cook food products quickly, and thereby minimize the wait time required. High quality food is assured because the quick-cooking capability allows fresh ingredients to be used and, ultimately, a fresh finished product to be delivered to the consumer. High quality food is further assured by the use of two cooking methods: hot air impingement for browning and crisping the food exterior, and microwaves for cooking the food interior. Finally, such an oven assures the consumer of an appropriate time frame to deliver the high quality food product because the hybrid cooking means functions to cook all food products quickly.

Accordingly, it is an object of the present invention to provide a system, within a recycling hot air impingement oven, that is capable of rapidly modifying the air temperature, thereby enabling operations whereby a consumer can cook single entree portions of food within a limited period of time (e.g., 30 to 60 seconds), depending upon the food type, volume, and whether the food product is in a frozen, refrigerated, or ambient state.

Another object is to provide such a system that in one embodiment works in an oven using hot air impingement means alone to cook food products.

Yet another object is to provide such a system that in another embodiment works in concert with microwave cooking means to cook food products even more rapidly than with hot air impingement alone.

A further object is to provide such a system that contributes to the oven's ability to cook food products that are at least of the quality of food served at fast food restaurants.

It is another object of the present invention to provide such a system which does not diminish the oven's ability to cook a wide range of food products, one after another, but at a faster rate than without such a system.

It is a still further object to provide such a system which is safe, simple, and economical to manufacture, use, and maintain.

SUMMARY OF THE INVENTION

It has now been found that the above and related objects of the present invention are obtained in a system for rapid air temperature modification in a recycling oven using hot air impingement for cooking. In such a system the recycling air may be made to selectively bypass the heat exchanger, thereby to rapidly achieve reduced cook chamber temperatures, as desired by the user.

A preferred embodiment of the present invention is a system that comprises a shell or conduit configured and dimensioned to receive a stream of air through an inlet and to discharge a stream of air through an outlet. The shell is further configured to provide independent first and second paths of travel to guide independent streams of air passing between the inlet and outlet of the shell. The first path houses heating means so that all air passing through this first path will be conditioned (heated) by the heating means. The second path has no heating means and merely permits passage of the stream of air through the shell, preferably unimpeded passage. A mixing space or chamber exists just prior to the outlet of the shell, wherein the air leaving the first path is mixed with the air leaving the second path, so that a single, common thermally-uniform stream of air is created prior to such united stream passing through the outlet and into the cooking chamber. Control means maintain the temperature of the air leaving the outlet at a level according to a predetermined temperature.

In a preferred embodiment of the present invention, the shell further comprises an adjustable baffle located adjacent the entrances of the first and second paths to vary the volumes of the air streams passing through the first and second paths. In this instance, the control means includes means for adjusting the baffle in response to at least one factor selected from the group consisting of a change in the temperature of the cooking chamber or a change in the predetermined temperature. It will be appreciated that the second path is devoid of any heating means comparable to that in the first path for heating the stream of air passing therethrough.

The system is preferably disposed between a blower means, providing a steady stream of air into the system, and a cooking chamber, receiving impingement air from the system for cooking various food items placed into the cooking chamber.

The present invention additionally encompasses a method of rapidly modifying cook temperatures within a recycling oven. A shell is provided having an inlet for receiving a stream of air and an outlet for expelling a stream of air as well as a first and second path for at least partially conducting independent streams of air between the inlet and the outlet. Only the stream of air that passes through the first path is heated. The air stream leaving the first path and the air stream leaving the second path are mixed prior to leaving the outlet. The amount of heat transferred to the air passing through the first path is controlled, and the ratio of the volumes of the air stream passing through the first and second paths is controlled, in order to allow their mixed temperature to match some predetermined temperature.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
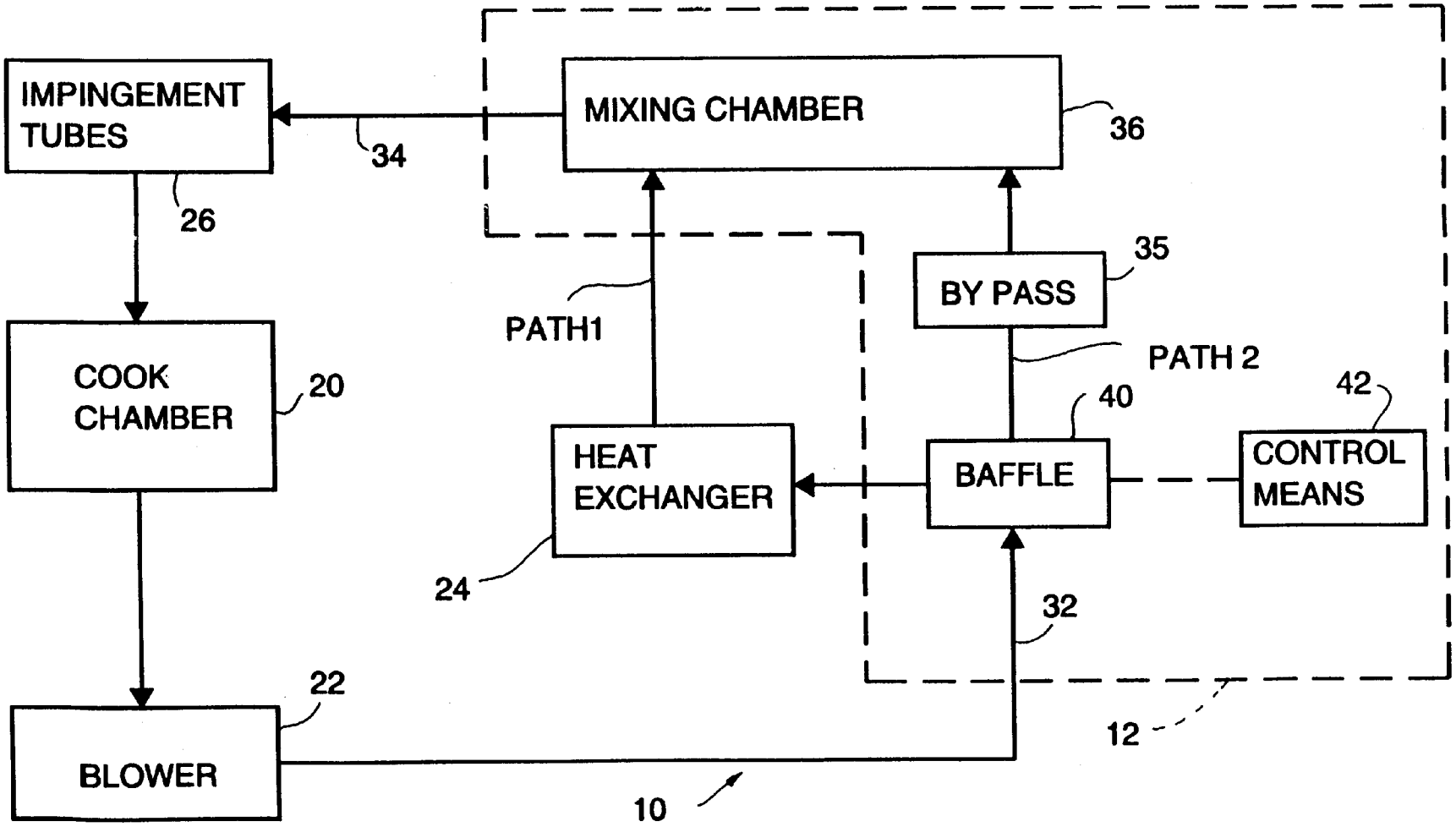
FIG. 1 is a schematic block diagram of the system of the present invention.
Figure 2:
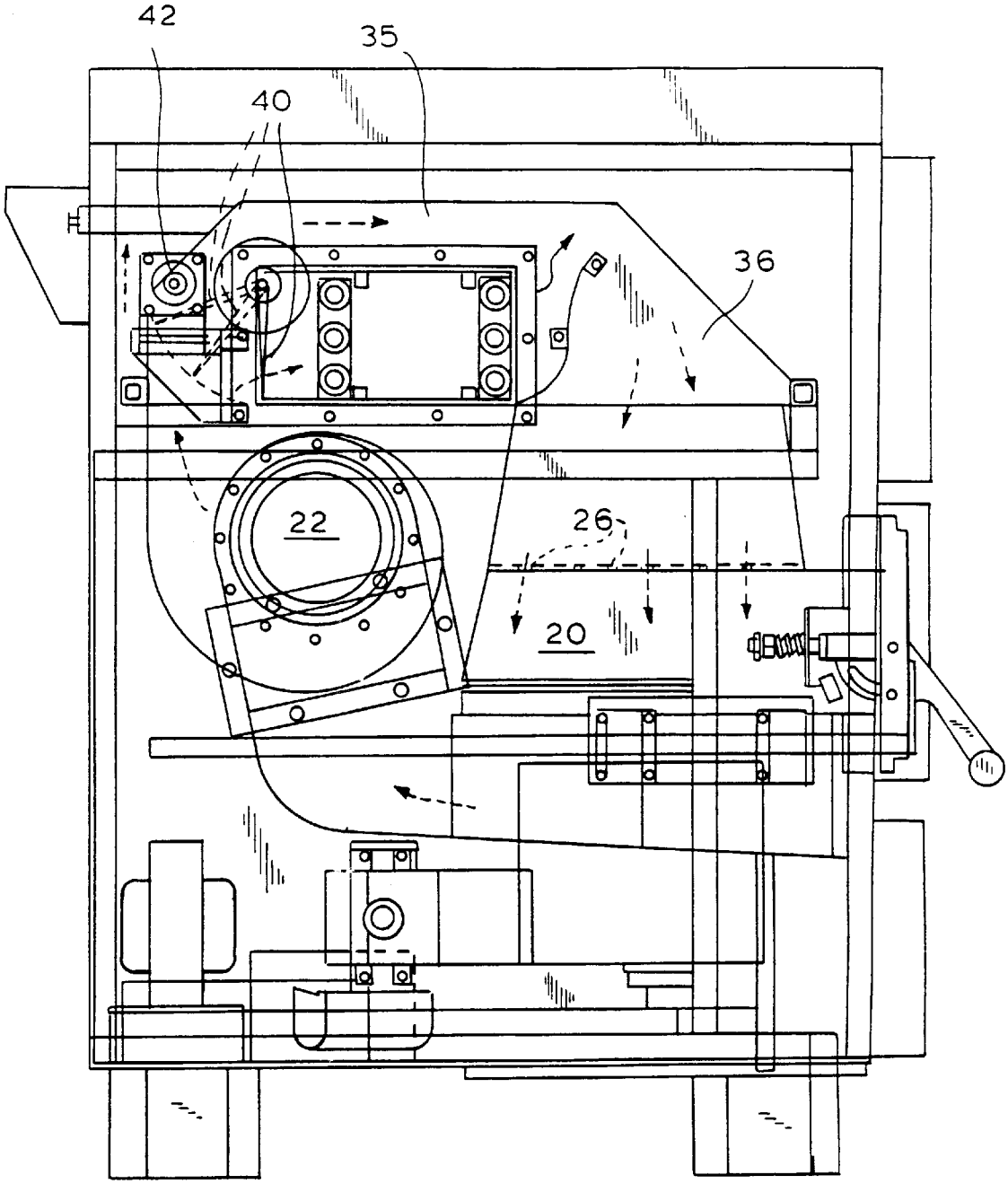
FIG. 2 is a side sectional view thereof.

Referring now to the drawings, and in particular to FIG. 1 thereof, therein illustrated schematically is a recycling oven, generally designated 10, incorporating (as illustrated in broken line) the system of the present invention for rapid air temperature modification, generally designated 12.

In its conventional aspects, the recycling oven includes a cook chamber 20 wherein the food is cooked at least partially by hot air impingement, a blower 22, a heat exchanger 24 disposed in a path 1 (or other means for contributing heat to the air traversing path 1) and impingement tubes 26 (or other apertures in the top of the cook chamber 20) for introducing streams of hot impingement air into the cook chamber 20. While the blower 22 is illustrated as being intermediate the cook chamber 20 and the heat exchanger 24, clearly it may be disposed elsewhere as well—for example, intermediate the heat exchanger 24 and the impingement tubes 26. It will be appreciated that the term "heat exchanger" is used broadly to include any means for directly or indirectly heating the air passing therethrough (e.g., using burners). As the overall conventional configuration of a hot air recycling oven is well-known to those skilled in the oven art, further details thereof are not deemed necessary herein.

Turning now to the novel aspects of the present invention, the system for rapid air temperature modification is illustrated within the dotted line 12. The system comprises a shell or air conduit having an inlet 32 for receiving a stream of air (typically hot air which has been cooled somewhat in the cook chamber 20) and an outlet 34 for discharging a stream of air (which enters the impingement tubes 26 for passage into the cook chamber 20). Associated with the shell are a first path (labeled PATH 1) and a second path (labeled PATH 2) disposed intermediate the inlet 32 and the outlet 34 to guide independent streams of air through the shell. A heat exchanger or like heating means 24 is conventionally disposed in the first path for heating a stream of air passing through the first path. The heating means 24 heats the stream of air passing through the first path relative to the stream of air passing through the second path. The stream of air passing through the second path typically passes through a bypass 35 about the heating means 24 and is not intentionally heated at all, although it may receive some heat due to its proximity to the heating means 24.

A mixing chamber 36 is disposed adjacent and before the outlet 34. The stream of air leaving the first path joins and mixes with the stream of air leaving the second path within the mixing chamber 36 so that a single thermally-uniformed stream of air passes through the outlet 34. When the blower 22 is disposed in the cutlet 34, it may also serve as the mixing chamber 36 for mixing the two streams of air.

An adjustable baffle 40 is located adjacent to the entrances to the first and second paths in order to vary the ratio of the volumes of the air streams passing through the first and second paths—e.g., to selectively limit the volume of air passing through the second path. By controlling the volume of air passing through one path, the remaining volume of air is forced to pass through the other path. Control means 42 are provided for adjusting the setting of the adjustable baffle 40 in response to variations in pertinent parameters of the cooking operation. The pertinent activity of the oven which is monitored by the control means 42 and provides the basis for adjustment to the baffle 40 is a change in the temperature of the cooking chamber 20, a change in the predetermined temperature of the air leaving the outlet 34 or a combination thereof. More particularly, the control means 42 adjust the baffle 40 for maintaining the temperature of the air leaving the outlet 34 at a level according to a predetermined temperature.

The control means 42 preferably operates according to two control loops. The first control loop is solely dedicated to maintaining the heat exchanger at a preset temperature higher than the cook chamber temperature. For most foods the preset temperature is about 600–850° F. but about 300–600° F. for baked goods. It should be readily apparent to one skilled in the art that alternatively, there may be cases in which the desirability of minimizing oven size and/or peak power input would dictate a smaller heat exchanger running at a higher temperature. In other words, a smaller heat exchanger running at a higher temperature (e.g., 1200° F.) could supply the same or a substantially larger amount of heat energy to the air passing through it as a larger heat exchanger running at a lower temperature (e.g., 650° F.). Or, a heat exchanger operating at a higher temperature (e.g., 1200° F.) could be used to store energy for short periods of time to reduce the peak input power requirements of an oven (e.g., (850–850° F.). Obviously since the preferred cook temperature is independent of the cook chamber size and heat exchanger operating temperature, the air bypass system discussed herein provides a specific means to accomplish delivery of the desired cook temperature, even from a smaller heat exchanger operating at a significantly higher temperature (e.g., 1200° F.).

In a conventional recycling hot air impingement oven, sophisticated controls are necessary to maintain the heat exchanger at a preset temperature because the energy input to the heat exchanger must be varied as the air speed therethrough changes. Varying air speed changes result in a varying volume of air within the heat exchanger for heating to a predetermined temperature. This problem is avoided by the present invention because the heat exchanger attempts to maintain a constant preset temperature and any necessary variation in the temperature of the air leaving the outlet 34 is achieved on a real time basis by a baffle or like means for varying the ratio of the volumes of the air streams passing into the first and second paths. Of course, over time a resetting of the preset heat exchanger temperature may be required.

The second control loop is solely dedicated to maintaining a constant temperature in the cooking chamber 20, typically 300 to 550° F. (preferably 520° F.) and hence at the outlet 34. The second control loop is responsible for adjusting the baffle 40 to vary the ratio of the volumes of the air streams allowed to travel the two paths, while taking into account the cook settings—e.g., the blower speed and, in the case of a hybrid oven, the microwave energy level.

Preferably, the heat exchanger temperature maintained by the first control loop is set at a much higher level than the cooking chamber temperature, as the air passing therethrough (and through the first path) will be mixed with cooler recycled air from the second path prior to entrance to the cook chamber 20. An advantage of this feature is that it permits the heat exchanger to have a relatively small amount of surface area, relying on the higher temperature of the heat exchanger to transfer the appropriate amount of heat to the passing air. Once the heat exchanger reaches the desired temperature, it is left there and the temperature at the outlet 34 (and hence the temperature in the cook chamber 20) is adjusted via the second control loop.

As will be apparent to those skilled in the art, the present invention, utilizing a bypass to avoid passage through the heat exchanger, allows the recycling oven to maintain a closed loop—that is, to avoid having to draw in substantial amounts of cool outside air. The closed loop system is advantageous because of its simple design which requires only a minimum of extra ducting with no additional blower. Hence, there is an energy and cost saving associated with the present invention.

Furthermore, outside air would be far too cool to efficiently and economically reduce the air temperature within the cooking chamber to a lower level. Thus, the present invention simply uses recycled air, which typically has lost approximately 100–150° F. during passage through the cooking chamber 20, depending upon the heat losses in the oven and the amount of food placed in the oven (the oven walls and food serving as heat sinks). This recycled air is naturally at an ideal temperature level to rapidly facilitate a desired reduction in the temperature of the cooking chamber. Typical recipes may require temperature drops in the oven of usually no more than 100° F., and the present invention enables rapid temperature drops in the oven of up to 100° F., typically 100–150° F. It will be recognized, however, that the walls of the oven 10 (preferably formed of stainless steel) act as a heat sink. The greater the heat sink effect, the higher the temperature swings possible on a real time basis because the oven walls remove more heat from the hot air stream. Of course, on a relatively long term basis (about 15 minutes) the swings in the cooking chamber temperature may be greater and centered about a lower different temperature as the cooking chamber walls either absorb or release heat.

It should be appreciated that the present invention does not exclude the possibility of using outside air, which is even cooler than the recycled air entering the inlet 32, for such purposes as cooling the magnetrons of a hybrid oven, the control panel of the oven, or the exterior housing of the oven without substantially affecting the temperature of the recycled air. Indeed, in those instances where a more rapid cooling of the recycled air is desired than can be achieved simply through use of the bypass, means may be provided (not shown) for introducing cool external air (that is, ambient air from outside of the oven) into the recycled air stream. This cool external air may be introduced either at the mixing chamber 36, upstream of the mixing chamber 36 in the bypass ducting 35 or, less preferably, downstream of the mixing chamber 36 at the outlet 34. If necessary, a blower or other means may be employed to ensure that the cool external air enters the stream of recycled air, which may be at a pressure greater than atmospheric.

Because the cooking chamber temperature may be rapidly varied according to the food products in the cooking chamber, the oven may be used to cook a wide range of food products, one after another, even when the different food products require widely different cook temperatures. In instances where the complete cooking of a food product is preferably performed at different temperatures at different points during the cook cycle, the ability to vary the cook temperature rapidly and without human intervention enables the finished product to be of high quality—in many cases higher than the quality provided by fast food restaurants. For example, when a steak is "seared" and then moved to a lower temperature, that "human intervention" causes a higher quality product than had the steak been cooked from beginning to end without changing cook temperature. This is because the "searing" process seals in the juices inherent in the steak. The oven of the present invention delivers higher quality than might be possible in a food service operation where skilled labor is limited, because the oven of the present invention can modify the cook temperature and air velocities without "human intervention."

To summarize, the present invention provides, within a recycling hot air impingement oven, a system that is capable of rapidly modifying the air temperature, thereby enabling operations where a consumer can cook single entree portions of food within a limited period of time (e.g., 30–60 seconds) depending upon the food type, volume and whether the food product is in a frozen, refrigerated or ambient state. The oven may rely on hot air impingement means alone for cooking or on hot air impingement means in concert with microwave cooking means, thereby to cook food products even more rapidly then with hot air impingement alone. Because the temperature used for cooking the food products may be varied rapidly, the food products may be of at least the quality served at fast food restaurants and the oven may be used to cook a wide range of food products, one after another, but at a faster rate then without such a system. The system is safe, simple and economical to manufacture, use and maintain.

Now that the preferred embodiments of the present invention have been shown and described in detail, various modifications and improvements thereon will become apparent to those skilled in the art. Accordingly, the spirit and scope of the present invention is to be construed broadly and limited only by the appended claims, and not by the foregoing specification.

We claim:

1. In an essentially recycling air oven, a system for rapid air temperature modification comprising:

(A) a shell having an inlet for receiving a stream of air and an outlet for discharging a stream of air;

(B) associated with said shell, a first path and a second path disposed between said inlet and said outlet to guide independent streams of air through said shell;

(C) a heating means disposed within said first path for heating a stream of air passing through said first path;

(D) a chamber disposed adjacent and before said outlet in which the stream of air leaving said first path joins and mixes with the stream of air leaving said second path so that a single, thermally-uniform stream of air passes through said outlet; and (E) control means for maintaining the temperature of air leaving said outlet at a level according to a predetermined temperature.

2. The system of claim 1 wherein said shell is disposed within said oven between a blower means for supplying air to said inlet and a cook chamber for receiving air from said outlet.

3. The system of claim 1 wherein said shell further comprises an adjustable baffle responsive to said control means and located adjacent entrances of said first and second paths to vary the ratio of the volumes of the air streams passing through said first and second paths.

4. The system of claim 3 wherein said control means includes means for adjusting said baffle in response to at least one factor selected from the group consisting of a change in the temperature of said cooking chamber, a change in the predetermined temperature, and a combination thereof.

5. In an essentially recycling air oven, a system for rapid air temperature modification disposed between a blower and a cooking chamber of said given, comprising:

(A) a shell having an inlet for receiving a stream of air and an outlet for discharging a stream of air;

(B) associated with said shell, a first path and a second path disposed between said inlet and said outlet to guide independent streams of air through said shell;

(C) a heating means disposed within said first path for heating a stream of air passing through said first path relative to a stream of air passing through said second path;

(D) an adjustable baffle located adjacent entrances to said first and second paths to vary the ratio of the volumes of the air streams passing through said first and second paths;

(E) a chamber disposed adjacent and before said outlet in which the stream of air leaving said first path mixes with the stream of air leaving said second path so that a single, thermally-uniform stream of air passes through said outlet; and (F) control means for adjusting said baffle for maintaining the temperature of air leaving said outlet at a level according to a predetermined temperature.

6. A method of rapidly modifying cook temperatures within an essentially recycling oven, comprising the steps of:

(A) providing a shell having an inlet for receiving a stream of air and an outlet for discharging a stream of air, and further having first and second paths for at least partially conducting independent streams of air between the inlet and the outlet;

(B) heating only the stream of air that passes through the first path;

(C) mixing the air streams leaving the first path and the second path prior to their leaving the outlet; and (D) controlling the amount of heat transferred to the air passing through the first path while controlling the ratio of the volumes of the air streams passing through the first and second paths in order to allow their mixed temperature to match some predetermined temperature.

7. The method of claim 6 wherein the stream of air passing through the second path is limited by baffling means.

8. An essentially recycling air oven including a system for rapid air temperature modification, comprising:

(A) an inlet for receiving a stream of recycled air and an outlet for discharging a stream of recycled air;

(B) means defining a first path and a second path disposed between said inlet and said outlet to guide independent streams of air therealong;

(C) heating means disposed within said first path for heating the stream of recycled air passing through said first path;

(D) mixing means for mixing the stream of recycled air leaving said first path and the stream of recycled air leaving said second path so that a single, thermally-uniform stream of recycled air passes through said outlet; and (E) control means for maintaining the temperature of recycled air leaving said outlet at a level according to a predetermined temperature.

9. The system of claim 8 wherein said inlet and outlet are disposed within said oven between a blower means for supplying air to said inlet and a cook chamber for receiving air from said outlet.

10. The system of claim 9 wherein said control means further comprises an adjustable baffle located adjacent entrances of said first and second paths to vary the ratio of the volumes of the air streams passing through said first and second paths.

11. The system of claim 10 wherein said control means includes means for adjusting said baffle in response to at least one factor selected from the group consisting of a change in the temperature of said cooking chamber, a change in the predetermined temperature, and a combination thereof.

* * * * *